United States Patent [19]

Eberle

[11] Patent Number: 4,519,308

[45] Date of Patent: May 28, 1985

[54] APPARATUS FOR DISPENSING AND COMPACTING PAPER TOWELS

[75] Inventor: Kurt Eberle, Scarborough, Canada

[73] Assignee: Johann K. Heuchert, Green Bay, Wis.

[21] Appl. No.: 557,040

[22] Filed: Dec. 1, 1983

[51] Int. Cl.[3] ..... B30B 1/04

[52] U.S. Cl. ..... 100/102; 100/233; 100/244; 100/295; 221/102; 221/135; 232/43.3

[58] Field of Search ..... 100/233, 266, 244, 268, 100/264, 257, 102, 295; 221/34, 102, 135; 232/43.1; 141/73

[56] References Cited

U.S. PATENT DOCUMENTS

| | | | |
|---|---|---|---|
| 1,688,242 | 10/1928 | Lawrence et al. | 221/34 |
| 2,478,815 | 8/1949 | Forman | 100/102 |
| 2,665,632 | 1/1954 | Kawa | 100/233 |
| 3,285,505 | 11/1966 | Katz | 232/43.3 |
| 3,753,506 | 8/1973 | Palmer et al. | 100/244 X |
| 4,398,456 | 8/1983 | Prater | 100/244 X |

FOREIGN PATENT DOCUMENTS

| | | | |
|---|---|---|---|
| 2031422 | 12/1971 | Fed. Rep. of Germany . | |
| 2030914 | 12/1971 | Fed. Rep. of Germany . | |
| 2718145 | 11/1978 | Fed. Rep. of Germany . | |
| 2468525 | 5/1981 | France . | |
| 464373 | 4/1937 | United Kingdom | 221/102 |

*Primary Examiner*—Billy J. Wilhite

*Attorney, Agent, or Firm*—Francis J. Bouda

[57] ABSTRACT

The towel cabinet of the present invention includes a first compartment for storing and dispensing clean, unused paper towels, and a second storage compartment for receiving and storing used paper towels. The two compartments are connected by a manual control which, when actuated, opens a door in the first compartment to permit a clean towel to be exposed and removed and at the same time actuates a panel in the second compartment which compresses used towels into the second compartment. An elevator is provided in the second compartment for adjusting the floorplate of the second compartment as more and more towels are compacted into it, and a corridor is provided between the door in the first compartment and the panel in the second compartment into which the clean towels are dispensed and disposed for retrieval by the operator and into which the used towel is discharged for movement by the panel into the second compartment. The apparatus of the present invention is particularly adapted for public restrooms to provide hygienic dispensing of clean towels and removal of used towels.

5 Claims, 4 Drawing Figures

FIG. 3
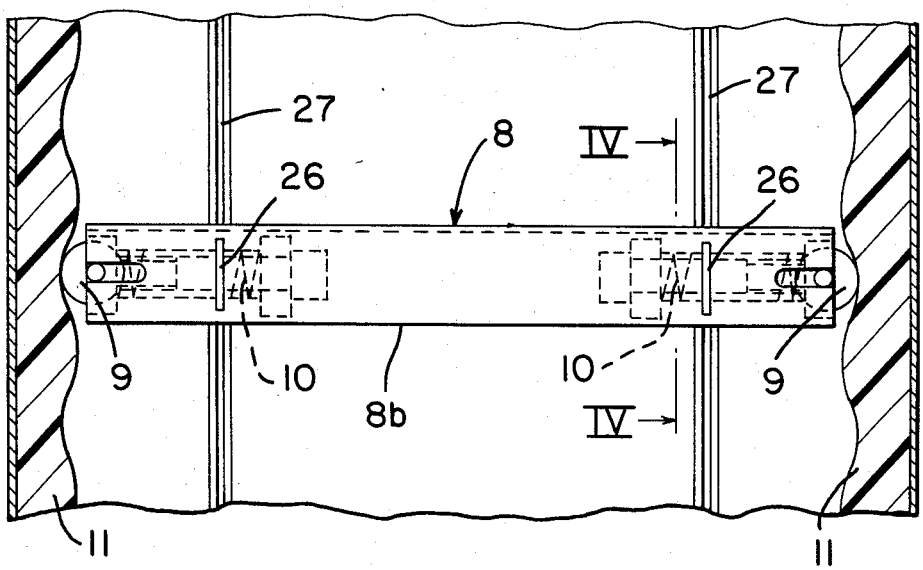
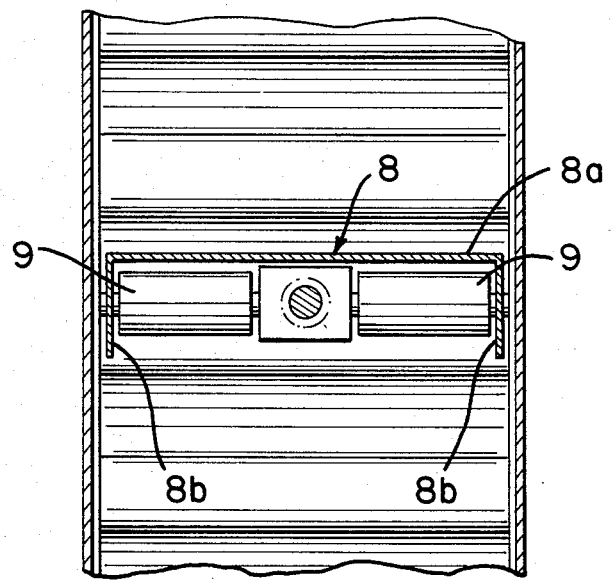
FIG. 4

APPARATUS FOR DISPENSING AND COMPACTING PAPER TOWELS

BACKGROUND OF THE INVENTION

This invention relates to an apparatus for dispensing hand towels (and the like) and simultaneously compacting the discarded ones.

It is known that paper towels are provided in bathrooms of public places, restaurants, hospitals, and similars. This provides hygienic means to dry wet hands, faces, etc.

With the cost of raw material constantly rising, strong interest exists to recycle the valuable paper material. This endeavor has been so far, without avail, because it is so difficult to return the used paper towels to the paper-making process.

Used paper towels are normally discarded into a waste basket or a nearby plastic garbage bag (see U.S. Pat. No. 1,688,242). Since the used towels are loosely crumbled and thrown away, a lot of space is required, the waste basket fills up quickly, and a lot of paper towels pile up on the floor. The waste basket is thus filled more with air than with paper towels. Frequent emptying of the waste basket becomes necessary, resulting in high labor costs. The large volume of discarded paper towels is a nuisance, because the large quantity of garbage (more air than refuse) takes up much room. This extensive space requirement makes it very difficult to store the wastepaper for later sale to recycling operations.

Prior attempts to solve this problem have involved crushers, such as that shown in U.S. Pat. Nos. 2,665,632 and 3,285,505. Crushers and dispensers and compactors have also been the subject of foreign inventors' activities as illustrated in German Pat. Nos. 2718145 and 2031422 and French Pat. No. 2468525. None of these, however, combine the advantages of the device which is the subject of the present invention.

The goal of this invention lies in the fact that the apparatus will not only dispense hand towels, but also provides the means to compact the used towels into a very small space.

The compacting dispenser of the present invention provides the solution to that task. The apparatus includes a housing having a holder dispenser for clean, unused towels and also having a used-towel compartment, which is equipped with an opening for filling it. The compartment has a floor which is movable against the effect of a force accumulator and is equipped with a compacting device in the area of the discard-opening. This invention has the advantage that paper towels can be dispensed and at the same time, the used ones, which were thrown into their discard opening, are compacted.

Thereby, as the fresh towels are being used and properly discarded into the compactor, a waste paper packet is formed, which has approximately the same volume as the fresh towels. This opens up the possibility to return the discarded towels to the supplier of the fresh ones. This makes it finally feasible to recycle the valuable paper stock.

With the above and other objects in view, more information and understanding of the present invention may be achieved by reference to the following detailed description.

DETAILED DESCRIPTION

For the purpose of illustrating the invention, there is shown in the accompanying drawings a form thereof which is at present preferred, although it is to be understood that the several instrumentalities of which the invention consists can be variously arranged and organized and that the invention is not limited to the precise arrangements and organizations of the instrumentalities as herein shown and described.

In the drawings, wherein like reference characters indicate like parts:

FIG. 3 is a partial cross section of another embodiment of the waste towel collector.

FIG. 4 is a partial cross section along IV—IV in FIG. 3.

Figure 1:
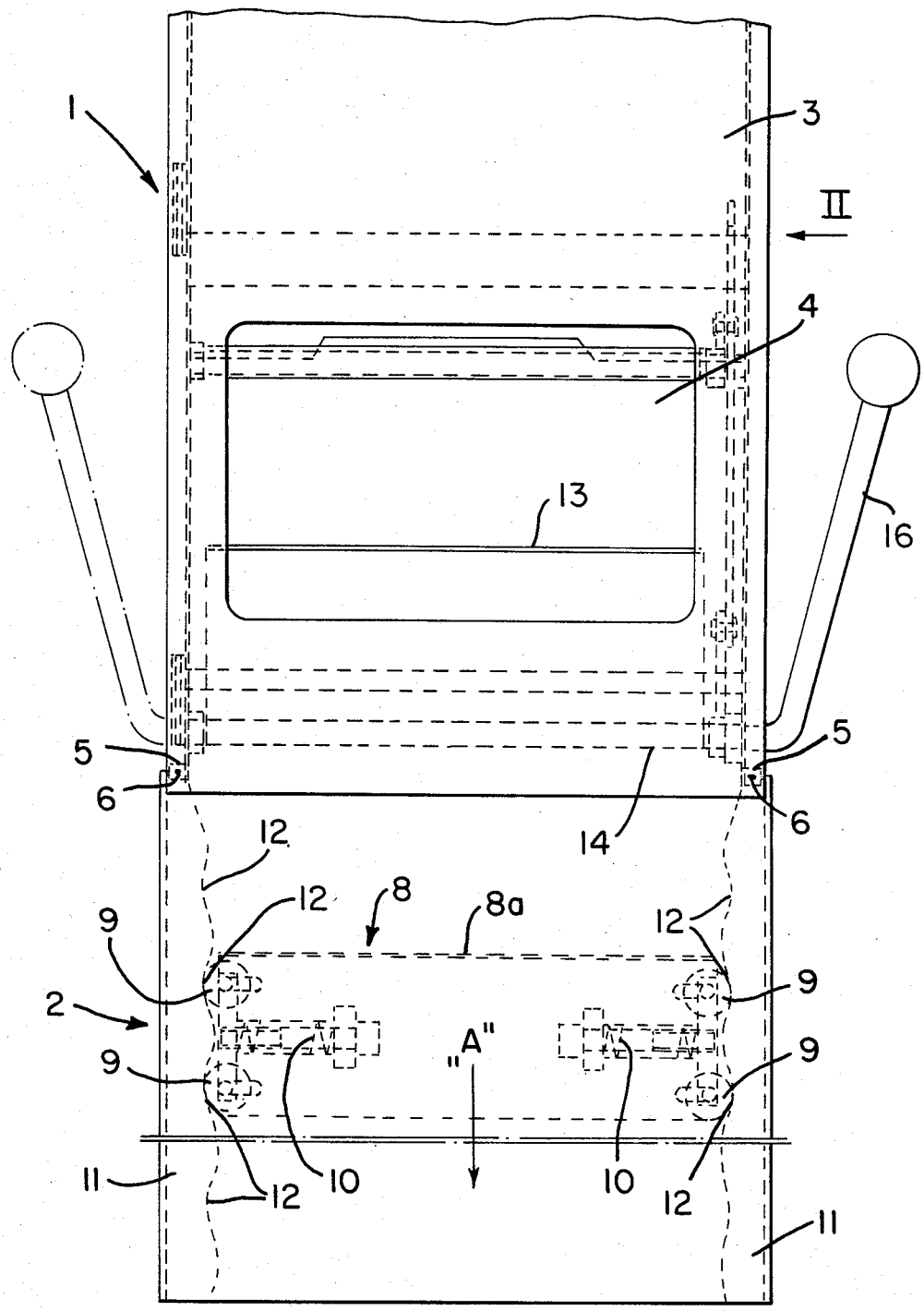
FIG. 1 is a front view of the paper towel dispenser and waste collector of the present invention.
Figure 2:
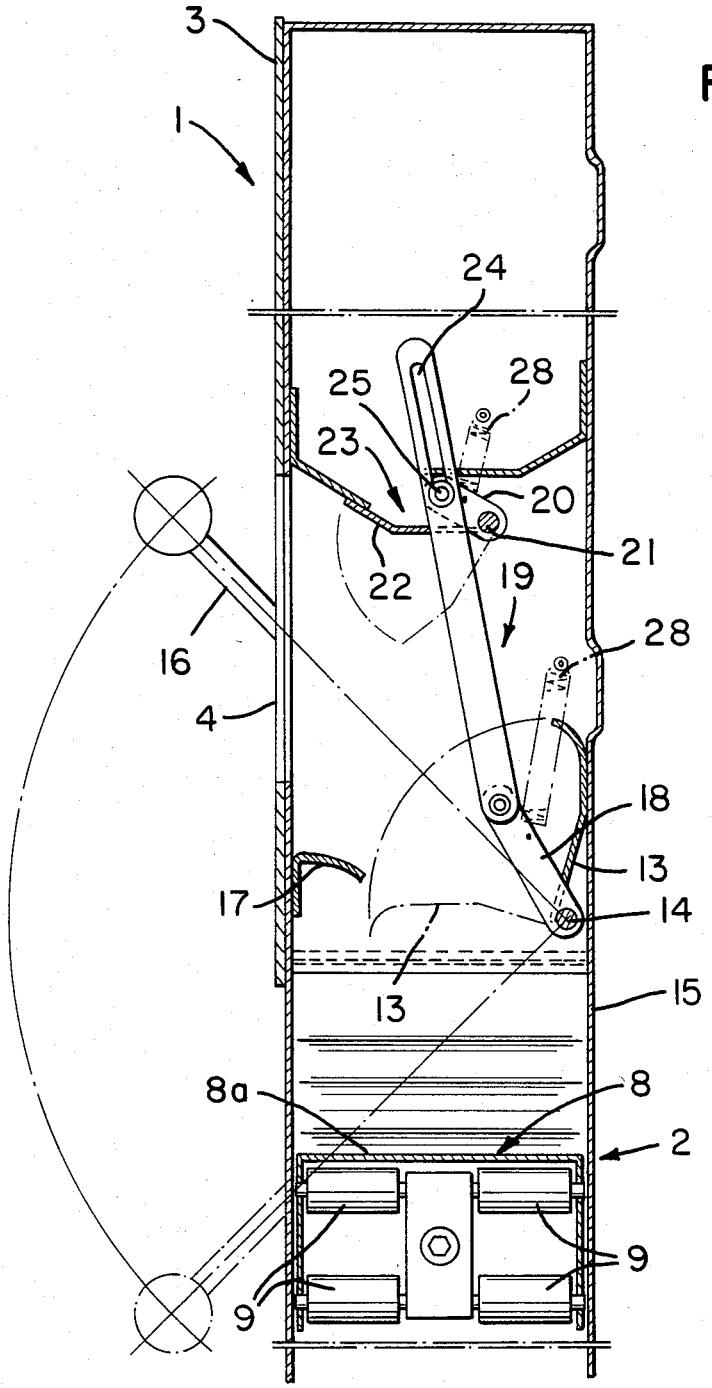
FIG. 2 is a side view as seen in the direction of the arrow II on FIG. 1, omitting the side wall.

In FIGS. 1 and 2, there is shown an apparatus which is a combination of a paper towel dispenser 1 and a waste collector 2.

The paper towel dispenser 1 is located above the collecting basket 2 and can be installed on the wall of a public toilet-room, or the like. The paper towel dispenser 1 is equipped with a door 3 on the front. The door 3 has a large dispensing opening 4 in the lower skirt thereof, through which the user can reach to get a clean towel.

The waste paper collector 2 can be removed from the dispenser 1 along the slides 5, which are fastened at the lower end of the dispenser, in which two gliding ribs 6 of the collector 2 slide. The slides 5 are covered by the lower part of the door 3, so that the collector basket 2 can only be removed or inserted if the door 3 is open. The collector bin 2, as shown in the example, consists of a rectangular housing, which is equipped with an upper opening 7, through which the used paper towels may be discarded. A movable floor 8 is provided for the basket 2 within the housing.

The floor 8 is a generally U-shaped member, whose open side is pointed downwards and whose center 8*a* represents the actual floor plate.

At each side of the floor plate 8, there are a number of rollers 9, which move parallel with the center 8*a*, against the action of two springs 10. The sides 11 of the collector bin 2 which are near the rollers 9 are wave-like, whereby the distance between two depressions 12 correspond to the distance of the roller pair 9. This assures that the movable floor plate 8 will always be in a relative position, as shown on FIG. 1, i.e., the roller pair 9 located on each side of the floor 8, will, independently from the floor's height, always engage in two opposite wave cavities. The floor 8 is moved downwards in the direction of the arrow A, as shown on FIG. 1, by overcoming the forces holding the rollers 9 in the depression 12 on the side plates 11. This force is governed primarily by the springs 10, which load the rollers 11 against the sides 11.

Near the opening 7, there is a pivoted lid 13, whose pivoting shaft 14 is located on the back 15 of the collector bin 2 and extends parallel to the back 15. The pivoting shaft 14 has at one end a handle 16, which can be manually operated. Depressing the handle 16 moves the lid 13 from its original position shown in dotted lines in FIG. 2 to the actuated position, shown in dotted lines, being nearly parallel to the movable floor 8.

When the collector bin 2 is empty, the floor 8 is moved upwards near to the fill opening 7. When used paper towels are discarded into the collector bin, the area between the floor 8 and the opening is filled first. When more paper towels are discarded through the opening 7 and the lid 13 is actuated, all of the towels in the collector bin are depressed and compacted. The amount of compression depends on the force required to move the floor 8 out of one position, downwards to the next set of depressions 12. This, furthermore, depends on the strength of the springs 10 and the shape of the wave-like sides 11.

As soon as the force which is applied onto the discarded waste paper towels by the lid 13 exceeds those forces which keep the floor 8 in its position, the floor 8 will be pushed downwards, towards the bottom of the collector bin 2. Herewith, it is accomplished that additional room is provided for more used paper towels. These are then compacted again, until the floor 8 is moved down into the next notch. This procedure is repeated until the discarded paper towels are compacted to minimum volume.

Since the lid 13 in its initial stage exposes the opening 7, it is recommended to attach a retainer 17 onto the lower end of the door 3 (below the opening 4) in front of the lid 13 so as to prevent the uncompressed paper towels from falling out of the collector bin.

The pivoting shaft 14 of the lid 13 is equipped with an arm 18, which is pivotally connected with another lever 19. The lever 19 is operatively connected with an arm 20, which is mounted on a shaft 21. Shaft 21 is equipped furthermore with a closure member 22, which opens or closes the dispensing opening 23 of the paper towel dispenser 1. The lever 19, which is operatively connected to the arm 20, is provided with a slot 24 in the coupling area, and in which a pin 25 interacts. The slot 24 provides initially a free travel of the arm 20, when the pivoting shaft 14 of the lid 13 is actuated by means of the lever 16. The free travel is of such dimensions that the actuation of the arm 20 and exposure of the dispensing opening 23, can only occur when the lid 13 is in a substantially horizontal plane. By these simple means, it is assured that a fresh paper towel is only dispensed by actuating the lever 16 which automatically compacts the previously discarded towels.

The arm 18, which is connected to the pivoting shaft 14, is equipped with a return spring 28, same as is the arm 20 to move the lever 16, the lid 13, and the lid 22 to their original positions.

The alternate design of the invention shown in FIGS. 3 and 4 differs from the design of FIGS. 1 and 2, only by the fact that the floor 8 is equipped with only two rollers. To assure that the floor 8 does not get jammed when depressed, parallel guides 26 and 27 are provided along the sides **8*b* of the "U" shaped floor 8 of the collector bin 2. This insures an exact guiding of the floor 8, although only two rollers are provided on the floor 8. This makes the building of a low profile floor 8 possible, thus providing a large volume collector bin 2**.

The collector bin 2 and the floor 8 could be made of plastic, or if preferred, also of metal. However, the wave like slides 11 ought to be of plastic, because it would be quite costly to make them out of metal.

As can be clearly seen on FIG. 1, it is posible to locate the lever 16, which actuates the lid 13, either on the right or on the left side of the dispenser 2. This depends on the space requirements of the installation site and customer preference.

The examples show the dispenser integrated with the compactor. Although both units could be separate (the dispenser 1 at one location in the room and the compactor 2 at another location in the same room), an advantage clearly exists to have both units at one location and interconnecting the compacting of used towels to the dispensing of new ones.

It is also possible that a bag-like liner made either of paper or plastic can be inserted into the compactor, above the floor plate 8 so that the towels are discharged directly into the bag. Once the bag is filled, it can be removed from the compactor and stored at a distance from the toilet room and another bag inserted into the collector. A paper bag has an advantage over a plastic bag because the entire bag and contents can be recycled.

Although it has been suggested that the device is particularly effective for public toilet rooms, it is to be understood that it is also adaptable for residential homes, apartment buildings, etc.

In addition, although the prior description considers the use particularly of individually-folded paper towels inserted into the dispenser in a stack, the bottom-most towel dispensed, one at a time, it is to be understood that the towel dispenser can also be accommodated to accept paper towel in roll form, in a manner well-known in the art.

Furthermore, the dispenser-compactor of the present invention can also be accommodated for a dispensing, collecting and compacting of other products, such as paper cups, napkins, facial tissue, industrial wipers and the like.

It is to be understood that the present invention may be embodied in other specific forms without departing from the spirit or special attributes hereof, and it is therefore desired that the present embodiments be considered in all respects as illustrative, and therefore not restrictive, reference being made to the appended claims rather than to the foregoing description to indicate the scope of the invention.

Having thus described my invention, what I claim as new and desire to protect by Letters Patents are the following:

1. A combination dispenser-compactor for disposable paper products, said dispenser-compactor having a body member including a holder for unused products and a receptacle for used products, a dispensing-opening in the holder and a receiving-opening in the receptacle, a movable cover for the dispenser-opening and a compactor cover above the receptacle and adjacent the receiving-opening, and an actuator operatively interconnected to said movable cover and said compactor cover whereby an unused product will be exposed and withdrawable through the dispenser-opening and the used products in the receptacle simultaneously will be compacted by the compactor cover when the actuator is operated.

2. A dispenser-compactor of claim 1 wherein said receptacle has a vertically-movable floor plate beneath the receiving-opening.

3. The dispenser-compactor of claim 2 wherein said receptacle has undulating side walls, and said floor plate has a spring-actuated roller engaging the side walls.

4. The dispenser-compactor of claim 3 wherein said compactor-cover is arranged to move the floor plate to the next undulation in the side walls when used products have been compacted above the floor plate beneath the compactor-cover sufficiently so that the force exerted on the actuator overcomes the resistance of the rollers against the undulations in the side walls.

5. A dispenser-compactor of claim 1 wherein said actuator is a manually-operable lever connected to the compactor cover.

* * * * *